US010682277B2

(12) United States Patent
Gayral et al.

(10) Patent No.: US 10,682,277 B2
(45) Date of Patent: Jun. 16, 2020

(54) EXOSKELETON INCLUDING A MECHANICAL ANKLE LINK HAVING TWO PIVOT AXES

(71) Applicant: WANDERCRAFT, Orsay (FR)

(72) Inventors: Thibault Gayral, Gentilly (FR); Alexandre Boulanger, Paris (FR)

(73) Assignee: WANDERCRAFT, Orsay (FR)

( * ) Notice: Subject to any disclaimer, the term of this patent is extended or adjusted under 35 U.S.C. 154(b) by 256 days.

(21) Appl. No.: 15/564,962

(22) PCT Filed: Apr. 7, 2016

(86) PCT No.: PCT/EP2016/057626
§ 371 (c)(1),
(2) Date: Oct. 6, 2017

(87) PCT Pub. No.: WO2016/162425
PCT Pub. Date: Oct. 13, 2016

(65) Prior Publication Data

US 2018/0055712 A1 Mar. 1, 2018

(30) Foreign Application Priority Data

Apr. 7, 2015 (FR) ..... 15 52975

(51) Int. Cl.
*A61H 1/02* (2006.01)
*A61H 3/00* (2006.01)

(52) U.S. Cl.
CPC ..... *A61H 1/0266* (2013.01); *A61H 1/024* (2013.01); *A61H 3/00* (2013.01); *A61H 2201/12* (2013.01);

(Continued)

(58) Field of Classification Search
CPC .. A61H 1/0237; A61H 1/0255; A61H 1/0262; A61H 1/0266; A61H 3/00; A61H 2003/007; A61H 3/008; B25J 9/0006
See application file for complete search history.

(56) References Cited

U.S. PATENT DOCUMENTS 8,388,559 B2 * 3/2013 Kudoh ..... A61H 3/008 601/35
8,394,038 B2 * 3/2013 Ashihara ..... A61H 3/008 601/33

(Continued)

FOREIGN PATENT DOCUMENTS

GB 2485454 5/2012
JP 2005296103 10/2005

(Continued)

OTHER PUBLICATIONS

Wandercraft, "French Preliminary Search Report," FR Application No. 1552975 (dated Jan. 19, 2016) (with English translation cover sheet).

(Continued)

*Primary Examiner* — Alvin J Stewart
(74) *Attorney, Agent, or Firm* — Womble Bond Dickinson (US) LLP

(57) ABSTRACT

The invention relates to an exoskeleton including: a foot structure; a lower leg structure; a mechanical knee link having a pivot axis; and a mechanical ankle link connecting the foot structure to the lower leg structure and including a first pivot connection having a first pivot axis that is substantially parallel to the pivot axis of the mechanical knee link, and a second pivot connection having a second pivot axis that is perpendicular to the first pivot axis and forms an angle of between 30° and 60° with the support plane when the exoskeleton is upright and at rest.

27 Claims, 10 Drawing Sheets

(52) U.S. Cl.
CPC ..... *A61H 2201/123* (2013.01); *A61H 2201/1238* (2013.01); *A61H 2201/149* (2013.01); *A61H 2201/164* (2013.01); *A61H 2201/165* (2013.01); *A61H 2201/1642* (2013.01); *A61H 2201/1673* (2013.01); *A61H 2201/1676* (2013.01); *A61H 2201/1678* (2013.01); *A61H 2201/5053* (2013.01)

(56) References Cited

U.S. PATENT DOCUMENTS

| | | | | |
|---|---|---|---|---|
| 9,381,961 | B1 * | 7/2016 | Kataoka | B62D 57/02 |
| 10,219,968 | B2 * | 3/2019 | Lee | A61H 3/00 |
| 2005/0107916 | A1 * | 5/2005 | Nagasaka | B62D 57/02 700/245 |
| 2006/0069336 | A1 | 3/2006 | Krebs et al. | |
| 2010/0063424 | A1 * | 3/2010 | Kudoh | A61H 3/008 601/35 |
| 2010/0210980 | A1 * | 8/2010 | Kudoh | A61H 3/008 601/34 |
| 2010/0256538 | A1 * | 10/2010 | Ikeuchi | B25J 9/0006 601/35 |
| 2012/0068422 | A1 * | 3/2012 | Kanaoka | B25J 9/0006 280/1.181 |
| 2012/0283613 | A1 | 11/2012 | DeHeer et al. | |
| 2013/0296754 | A1 * | 11/2013 | Campbell | A61F 5/0123 602/16 |
| 2013/0331744 | A1 * | 12/2013 | Kamon | A61H 3/00 601/35 |
| 2014/0221894 | A1 * | 8/2014 | Nagasaka | A61H 3/00 602/23 |
| 2015/0196450 | A1 * | 7/2015 | Lee | A61H 3/00 602/16 |
| 2015/0209215 | A1 * | 7/2015 | Lee | A61H 1/0237 623/27 |
| 2015/0272811 | A1 * | 10/2015 | Choi | A61H 3/00 623/27 |
| 2015/0321341 | A1 * | 11/2015 | Smith | A61H 1/0237 623/27 |
| 2015/0335515 | A1 * | 11/2015 | Lee | A61H 3/008 601/5 |
| 2016/0331624 | A1 * | 11/2016 | Sankai | A61H 1/024 |
| 2016/0331625 | A1 * | 11/2016 | Sankai | B25J 9/0006 |
| 2017/0360645 | A1 * | 12/2017 | Sodeyama | A61H 3/00 |
| 2018/0055711 | A1 * | 3/2018 | Choi | A61H 3/06 |
| 2018/0104075 | A1 * | 4/2018 | Mooney | A61H 1/0266 |
| 2018/0147108 | A1 * | 5/2018 | Lee | A61H 1/0244 |
| 2018/0160946 | A1 * | 6/2018 | Macko | A61B 5/4595 |
| 2018/0177664 | A1 * | 6/2018 | Choi | A61H 1/0259 |
| 2018/0289578 | A1 * | 10/2018 | Suzuki | A61H 1/0262 |
| 2019/0001488 | A1 * | 1/2019 | Xiong | B25J 9/126 |
| 2019/0142618 | A1 * | 5/2019 | Hyung | A61F 5/0102 602/16 |
| 2019/0183714 | A1 * | 6/2019 | Goto | A61H 3/00 |

FOREIGN PATENT DOCUMENTS

| | | |
|---|---|---|
| JP | 2012110497 | 6/2012 |
| KR | 20130045776 | 5/2013 |

OTHER PUBLICATIONS

Wandercraft, "International Search Report and Written Opinion," PCT Application No. PCT/EP2016/057626 (dated Aug. 16, 2016) (with English translation cover sheet).

* cited by examiner

EXOSKELETON INCLUDING A MECHANICAL ANKLE LINK HAVING TWO PIVOT AXES

FIELD OF THE INVENTION

The invention relates to a mobility aid system for a person, or exoskeleton, capable of supporting a user in particular affected by a motor impairment.

TECHNOLOGICAL BACKGROUND

An exoskeleton comprises, generally, a pelvis structure, two leg structures, two foot structures and two hip structures:

- The pelvis structure is configured to be positioned behind the kidneys of a user when wearing the exoskeleton and may be fixed to the pelvis by means of a harness or straps.
- Each leg structure is configured to be positioned facing one of the legs (left or right, depending on the structure) of the user, and comprises an upper leg segment and lower leg segment, arranged to face the thigh and the calf of the user, respectively.
- Each foot structure also comprises a support plane on which one of the feet (left or right, depending on the structure) of the user may be supported when the foot lays flat.
- Each hip structure is configured to be positioned facing one of the hips (left or right, depending on the structure).

Complete control of the exoskeleton requires actuators and structural links to allow movement of the exoskeleton and thus allow displacement of the user wearing the exoskeleton. The mechanical links typically comprise pivot links, sliding links and/or ball joint links, while the actuators may comprise cylinders, motors, etc.

These mechanical links and the actuators are selected to allow the movement of the exoskeleton without hurting the user who wears it. To this end, it is especially important not to apply forces that the user's limbs cannot withstand and to offer an exoskeleton having both a low profile and a moderate weight.

WO 2011/002306 for example describes a system for controlling an exoskeleton worn by a user and having actuators associated with different members of the exoskeleton each corresponding to a body part of the user. The exoskeleton comprises in particular a main foot actuator and a secondary foot actuator, configured for actuating the foot structure and enable it to adapt to the terrain.

To this end, the main foot actuator is configured for actuating rotation of the foot structure relative to the lower leg structure using a pivot link about an axis parallel to a pivot axis of the knee. The secondary foot actuator meanwhile is intended to allow the foot structure to adapt to the terrain. However, such an ankle structure is relatively complex, bulky, heavy and energy intensive.

There has also been proposed, in document FR 14 52370, filed on Mar. 21, 2014 on behalf of the Applicant, an exoskeleton comprising a leg structure, a foot structure and an ankle pivot link connecting the foot structure to the leg structure, wherein the ankle pivot link has an oblique pivot axis, i.e. a pivot axis that does not fall within any reference plane among the front plane, the sagittal plane and the horizontal plane of the exoskeleton. Thus, the ankle pivot link forms a non-zero angle comprised between 0° and 30° with the support plane of the foot structure, and a non-zero angle comprised between 0° to 45° relative to a plane perpendicular to the median longitudinal axis of the support plane. Such a configuration having the advantage of producing movements at the ankle which are similar to natural human movements with only one actuator oriented as shown above. The structure of the exoskeleton is simplified and lightened. Furthermore, this configuration reduces the lateral use of space of the leg, thus reducing the risk of collision during a walking motion.

SUMMARY OF THE INVENTION

An aim of the invention is therefore to provide a solution to both improve stability during a walking motion of an exoskeleton and correctly reproduce the human walking motion, which is compact and has a moderate weight.

For this, the invention proposes an exoskeleton comprising:

- a foot structure comprising a support plane configured to receive a foot of a user,
- a lower leg structure configured to receive a lower portion of a user's leg,
- a mechanical knee link configured to connect the lower leg structure to an upper leg structure configured to receive an upper portion of a user's leg, the mechanical knee link having a pivot axis, and
- a mechanical ankle link; connecting the foot structure to the lower leg structure, the mechanical ankle link comprising a first pivot link having a first pivot axis, said first pivot axis being substantially parallel to the pivot axis of the mechanical knee link. By substantially parallel, it is understood here that the first pivot axis X1 forms an angle comprised between 0° and about fifteen degrees with the pivot axis Y, preferably between about 6° and 10°, typically of the order of 8°.

The mechanical ankle link further comprises a second pivot link having a second pivot axis, which extends in a plane perpendicular to the first pivot axis and forms with the support plane an angle comprised between 30° and 60° when the exoskeleton is standing and at rest.

This configuration ensures planar contact between the foot structure of the exoskeleton and the ground during the standing phase of the walking motion, and a walking motion close to the biomechanical movement of a human being during the oscillation phase of the walking motion of the exoskeleton.

Some preferred but not limiting features of the exoskeleton described above are the following, taken individually or in combination:

- the second pivot axis forms an angle comprised between 40° and 50° with the support plane when the exoskeleton is standing and at rest, preferably of the order of 45°,
- the exoskeleton further comprises two actuators in parallel, fixed between the foot structure and the lower leg structure and configured to control an angular position of the foot structure about the first and the second pivot axis of the mechanical ankle link,
- the actuators are fixed in parallel on both sides of the lower leg structure,
- the actuators each comprise a linear actuator, mounted on the lower leg structure, and a connecting rod, mounted, on the one hand, on the linear actuator and on the other hand on the foot structure using a pivot joint, so that a translation of the linear actuator causes a rotation of the connecting rod relative to the foot structure, the linear actuators comprise a cylinder associated with a motor, preferably of the ball screw or screw-nut type, the cylinder comprises a threaded rod driven in rotation by the motor and a nut fixed in rotation relative to the foot structure, the connecting rod comprising one end mounted on the nut so that a translation of the nut causes a translation of the end of the connecting rod, each actuator further comprises at least one slide having a guide rail fixed to the lower leg structure, and a carriage, movable in translation along the guide rail, the nut being fixed to the carriage of the slide, the carriage comprises a first slider and a second slider, mounted movable in translation on the guide rail of the slide and connected integrally by a connecting part, the nut and the connecting rod being fixed to the connecting part of the carriage, a mechanical link between the nut and the connecting rod comprises a pivot link and a mechanical link between the connecting rod and the foot structure comprises a pivot joint, the mechanical link between the nut and the connecting rod comprises a universal joint, or two pivot links of substantially perpendicular axis, the cylinder further comprises a simple mechanical bearing interposed between an output of the motor and the threaded rod, said mechanical bearing having a misalignment comprised between five minutes of arc and fifteen minutes of arc, typically about ten minutes of arc, the first pivot link is positioned on the foot structure so as to face a medial malleolus and a lateral malleolus of a user wearing the exoskeleton and/or the second pivot link is positioned on the foot structure so as to face a heel or a user's Achilles tendon, the first pivot axis and the pivot axis of the mechanical knee link form an angle comprised between 0° and about fifteen degrees, preferably between 6° and 10°, for example 8°, the first pivot axis extends in a plane parallel to the ground when the exoskeleton is standing and at rest, the exoskeleton further comprises an intermediate part which is mounted, on the one hand, on the foot structure being free to rotate relative to the foot structure about the second pivot axis, and on the other hand, pivotally mounted about the first pivot axis on the lower leg structure, the intermediate part is mounted on the lower leg structure and on the foot structure with passive pivot links, the exoskeleton further comprises a compression spring assembly, fixed, on the one hand, to the intermediate part and on the other hand, on the lower leg structure, the spring assembly comprises a first elastically deformable member, the first member being connected, on the one hand, to the intermediate part, between the first and the second pivot link, by means of a fastening element, and on the other hand, to the lower leg structure, said first member being configured to apply a tensile force on the intermediate part, the fastening element is flexible, the spring assembly further comprises a substantially elongated hollow body having a first end and a second end opposite the first end, said hollow body being mounted in a housing formed in the lower leg structure, the first end of the hollow body being facing a bottom of the housing and the first member being mounted in the housing and compressed between the bottom of said housing and the second end of the hollow body, the exoskeleton further comprises a second elastically deformable member, housed in the hollow body, the second member being fixed near the first end of the hollow body, the fastening element cooperating with the second member so that the second member is configured to tension the fastening element and the fastening element being housed in the hollow body and projecting from the first end of said hollow body and the bottom of the housing, the first member and/or the second member comprises a compression spring, the first member and the second member comprise a compression spring, the second member having a lower stiffness than the stiffness of the first member, the fastening element has a thickened portion, housed in the hollow body and the second member comprises a locking part configured to form a stop for the thickened portion, the fastening element further comprises a stopper fixed to the fastening element, and the hollow body further comprises a protrusion fixed to an inner wall of the hollow body and configured to cooperate with the stopper and form an obstacle for the stopper of the fastening element, the hollow body further comprises a bolt, fixed near its second end, the first member abutting against said bolt.

A second aim of the invention is to provide a spring assembly capable of relieving the actuators of the exoskeleton during some phases of walking, for example during the standing phase at the end of the propulsion phase.

For this, the invention proposes a compression spring assembly, fixed, on the one hand, to a first part and on the other hand, on a second part, movable relative to the first part, comprising:

a first elastically deformable member, the first member being connected, on the one hand, to the first part by means of a fastening element, and on the other hand, to the second part, said first member being configured to apply a tensile force on the first part, and a substantially elongated hollow body having a first end and a second end opposite the first end, said hollow body being mounted in a housing fixed integrally to the second part, the first end of the hollow body being facing a bottom of the housing and the first member being mounted in the housing and compressed between the bottom of said housing and the second end of the hollow body.

Some preferred but not limiting features of the assembly described above are the following, taken individually or in combination:

the fastening element is flexible, the fastening element is a cable, the spring assembly further comprises a second elastically deformable member, housed in the hollow body, the second member being fixed near the first end of the hollow body, the fastening element cooperating with the second member so that the second member is configured to tension the fastening element and the fastening element being housed in the hollow body and projecting from the first end of said hollow body and the bottom of the housing, the housing is formed in the second part, the first member and/or the second member comprises a compression spring, the first member and the second member comprise a compression spring, the second member having a lower stiffness than the stiffness of the first member, the fastening element has a thickened portion, housed in the hollow body and the second member comprises a locking part configured to form a stop for the thickened portion, the fastening element further comprises a stopper fixed to the fastening element, and the hollow body further comprises a protrusion fixed to an inner wall of the hollow body and configured to cooperate with the stopper and form an obstacle for the stopper of the fastening element, the hollow body further comprises a bolt, fixed near its second end, the first member abutting against said bolt.

BRIEF DESCRIPTION OF THE DRAWINGS

Other features, aims and advantages of the invention appear better on reading the detailed description that follows, and the appended drawings given as non-limiting examples, in which.

DETAILED DESCRIPTION OF AN EMBODIMENT

Figure 1A:
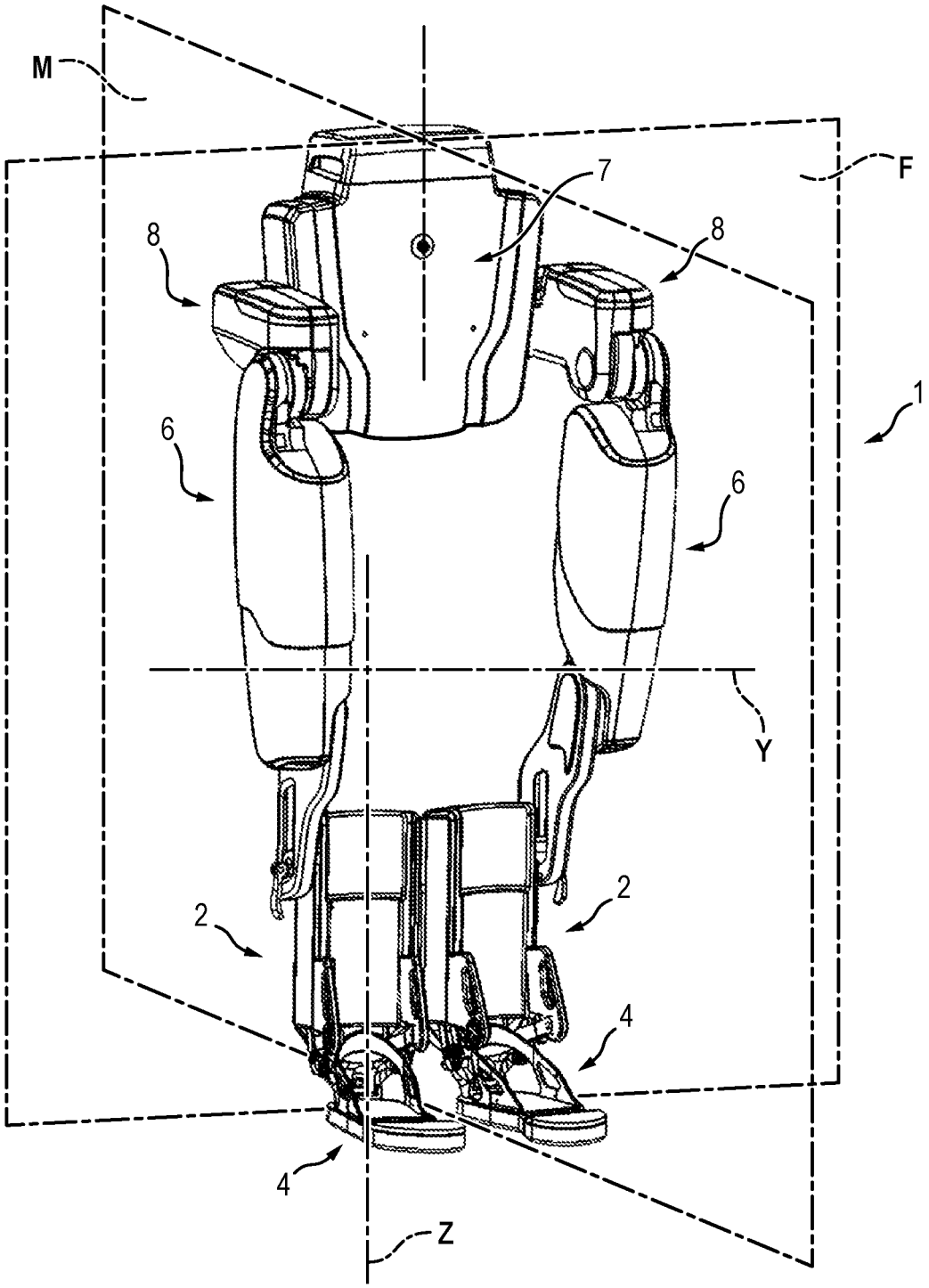
FIG. 1*a* is a perspective view of an embodiment of an exoskeleton of the invention.
Figure 1B:
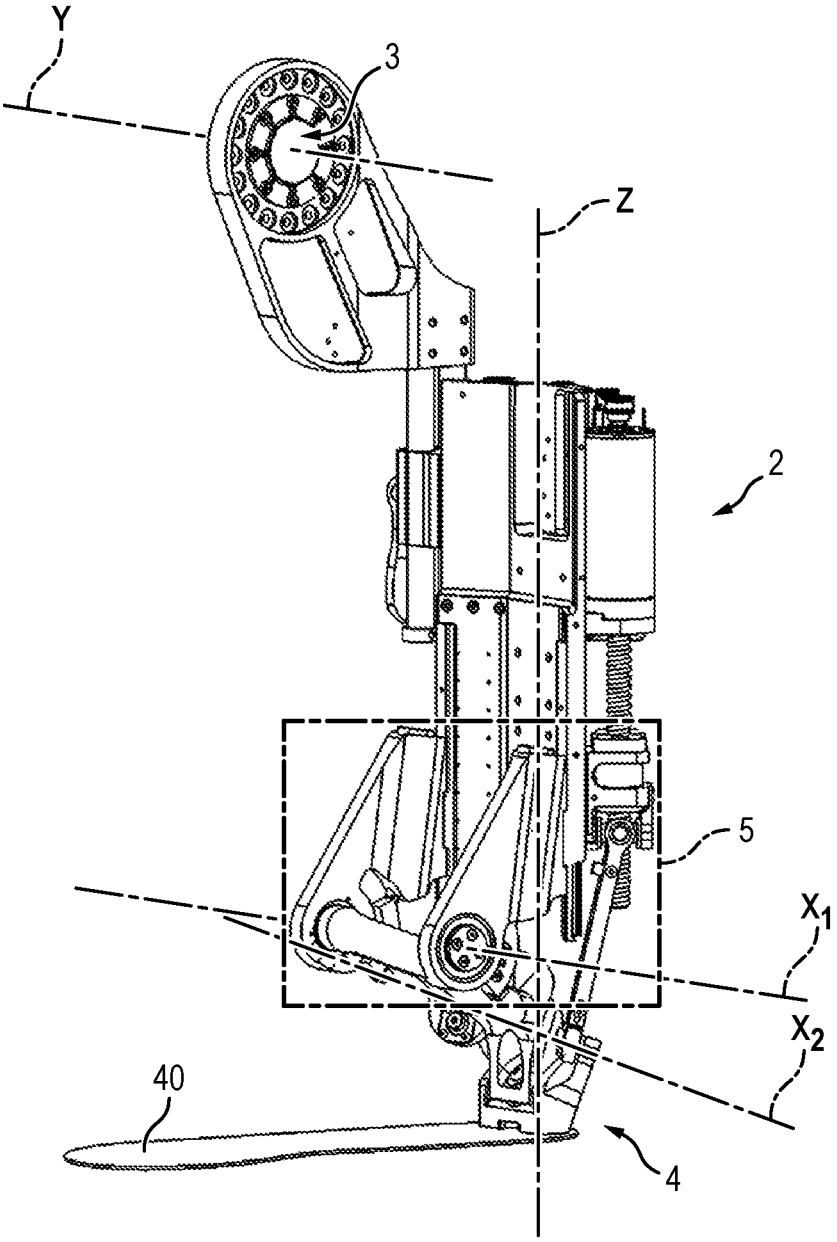
FIG. 1*b* is a detail view of a foot structure and a lower leg structure of the exoskeleton of FIG. 1*a*.
Figure 2:
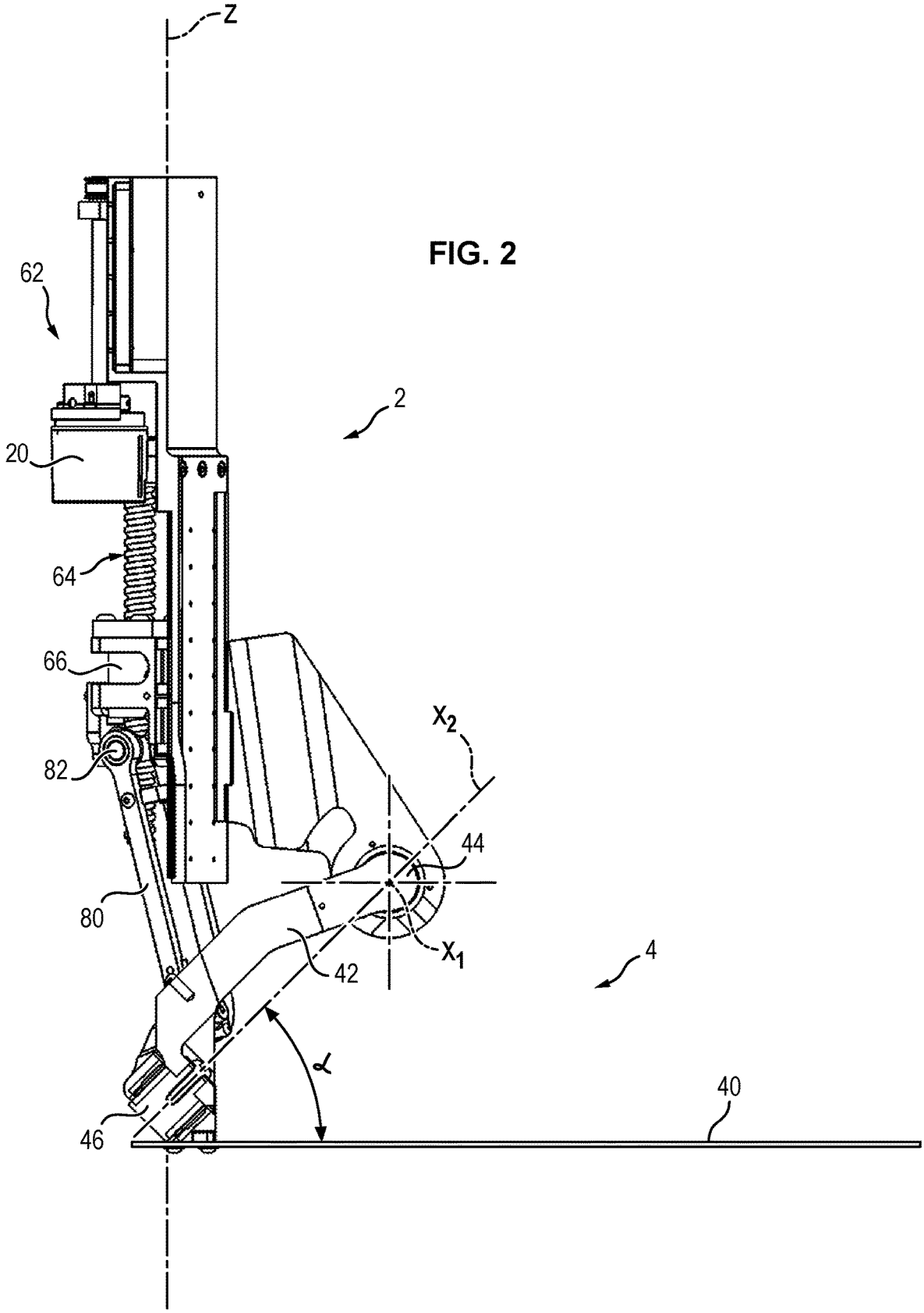
FIG. 2 is a side view in section of a first embodiment of a foot structure and a lower leg structure according to the invention.
Figure 3A:
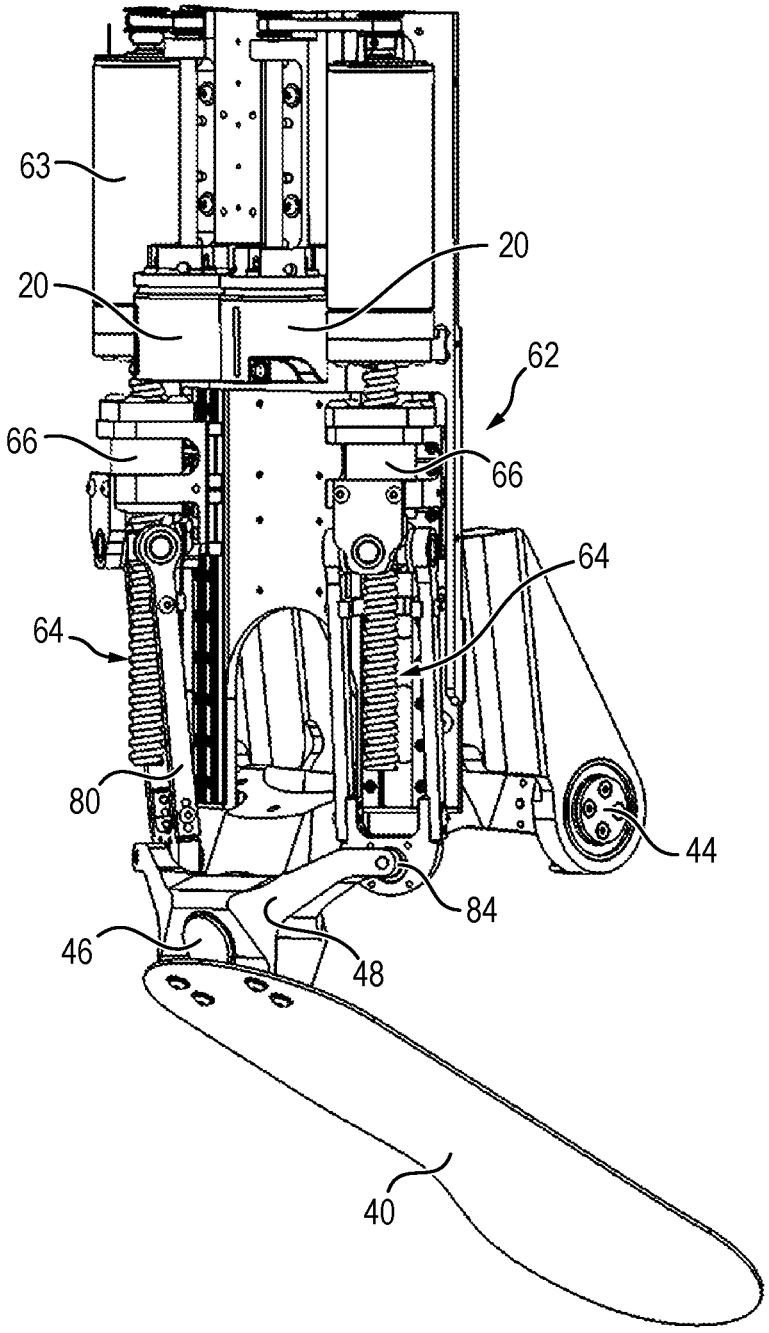
FIG. 3*a* is a rear three-quarter view of the structures of FIG. 2, the foot structure being tensioned.
Figure 3B:
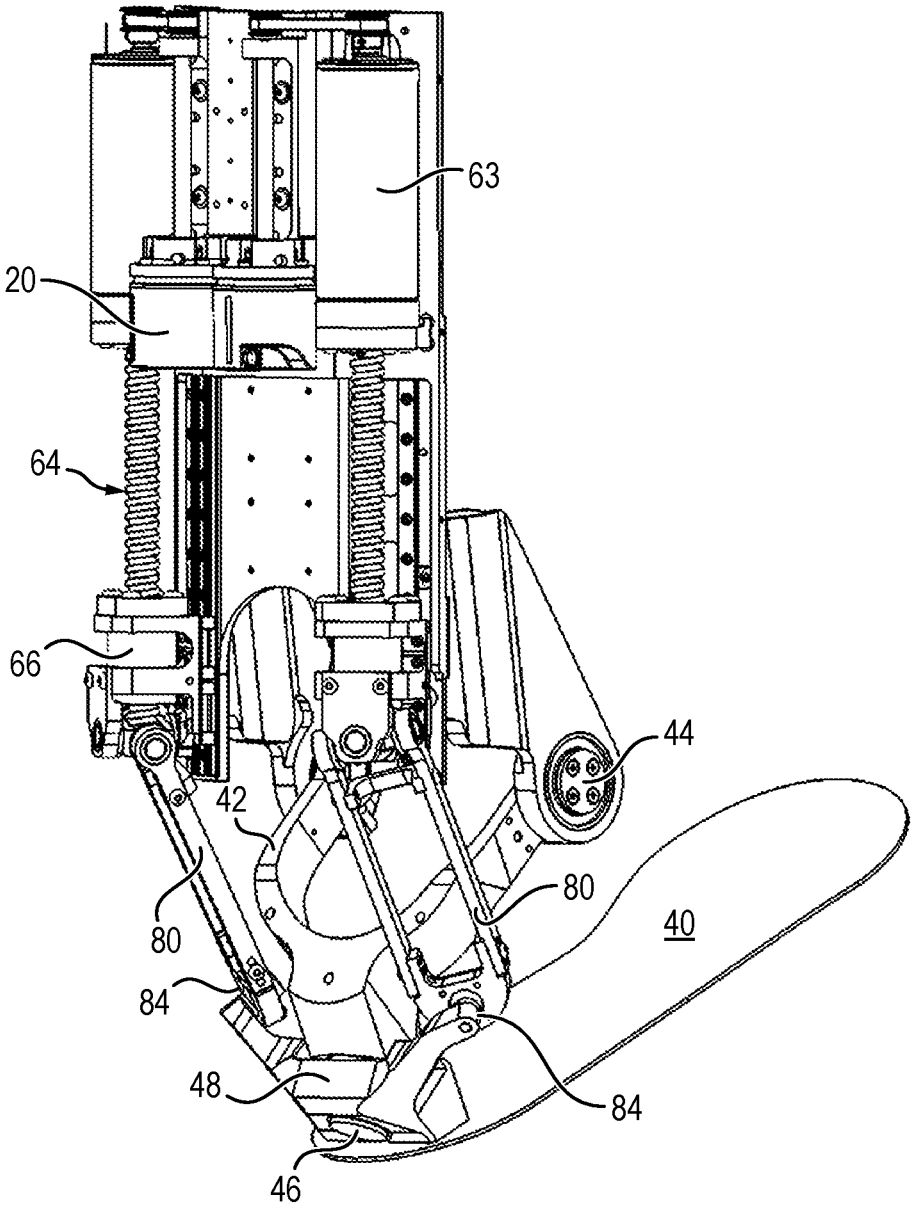
FIG. 3*b* is a rear three-quarter view of the structures of FIG. 2, the foot structure being flexed.
Figure 4:
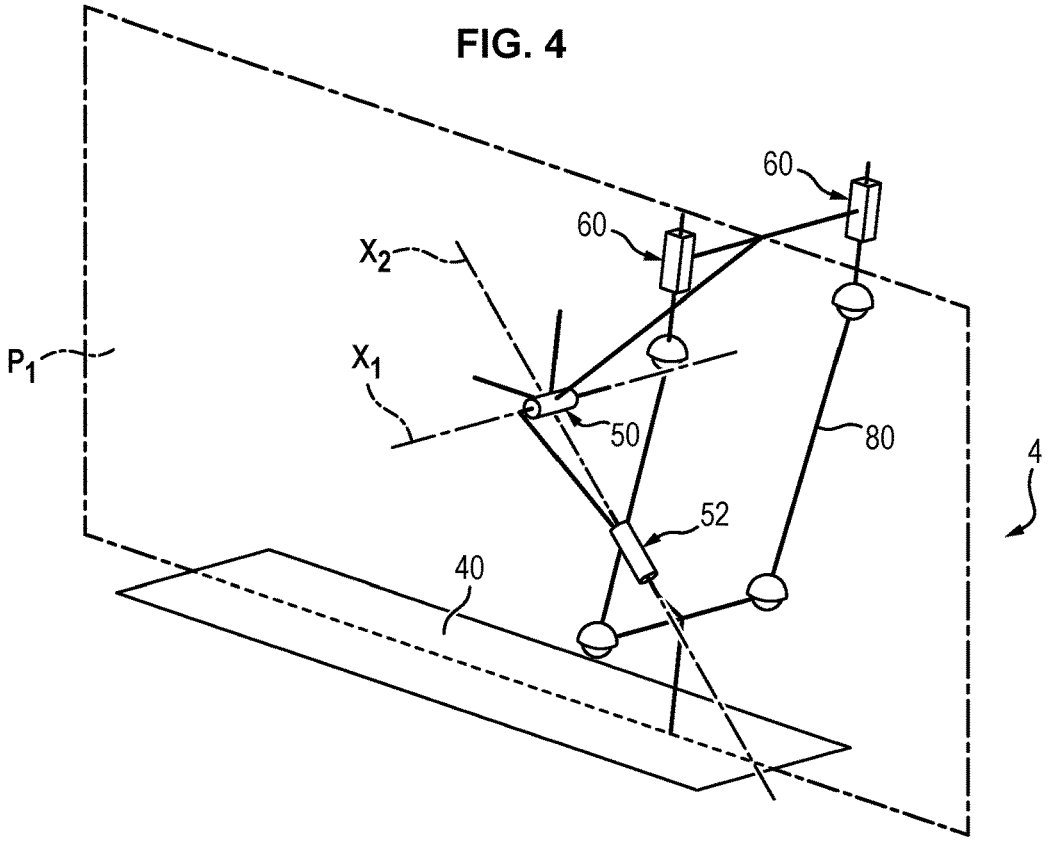
FIG. 4 is a kinematic diagram of the structures of FIG. 2.

An exoskeleton 1 according to the invention comprises:

a leg structure 4 comprising a support plane 40 configured to receive a foot of a user, a lower leg structure 2 and an upper leg structure 6, configured for respectively receiving a lower portion and an upper portion of a user's leg, a mechanical knee link 3, connecting the lower leg structure 2 to the upper leg structure, and a mechanical ankle link 5, connecting the foot structure 4 to the lower leg structure 2.

Optionally, the exoskeleton 1 may also comprise:

A pelvis structure 7, configured to be positioned behind the user's kidneys when wearing the exoskeleton 1 and which may be fixed to the user's pelvis by means of a harness or straps, and a hip structure 8 configured to be positioned facing one of the hips of the user, for example behind or to the side. Here, the hip structure 8 extends laterally relative to the associated hip of the user.

Preferably, the exoskeleton 1 is symmetrical about a median plane M of the exoskeleton 1 and comprises a right foot structure 4 and a left foot structure 4, a right leg structure and a left leg structure, a right mechanical knee link 3 and a left mechanical knee link 3, a right hip structure and a left hip structure, etc.

By median plane M of the exoskeleton 1, it is understood here the notional plane separating the left half from the right half of the exoskeleton 1. This plane M is also known under the name of median sagittal section.

The exoskeleton 1 also comprises a front plane F, which is a notional plane perpendicular to the median plane M and that separate the exoskeleton 1 in an anterior portion and a posterior portion.

In what follows, only one half of the exoskeleton 1 will be described, to facilitate the reading of the description. It is understood of course that this description applies mutatis mutandis to the left half of the exoskeleton 1, it is symmetrical to the right half of the median plane M of the exoskeleton 1.

Conventionally, the mechanical knee link 3 may have a pivot axis Y, to enable a user wearing the exoskeleton 1 to bend the knee, in particular during a walking motion. For this purpose, the mechanical knee link 3 may for example comprise a pivot link whose axis corresponds to the pivot axis Y of the knee. In one embodiment, the mechanical knee link has only one degree of freedom, namely rotation about the pivot axis Y.

The pivot axis Y of the knee extends generally perpendicularly to the walking direction of the exoskeleton 1 in a substantially horizontal plane.

The mechanical ankle link 5 for its part comprises a first pivot link 50 having a first pivot axis X1 and a second pivot link 52 having a second pivot axis X2. In one embodiment, the mechanical ankle link 5 comprises only these two degrees of freedom. The Applicant has in fact noticed that a mechanical ankle link with three degrees of freedom resulted in a significant increase in weight and bulk of the mechanical link, and only two degrees of freedom are sufficient to reproduce human walking and adapt to the terrain.

The first pivot axis X1 is substantially parallel to the pivot axis Y of the mechanical knee link 3, to allow the user to bend and stretch his foot in the foot structure 4. This movement corresponds for example to movement performed by the foot during a walking motion in a direction substantially perpendicular to the front plane F of the exoskeleton 1.

By substantially parallel, it is understood here that the first pivot axis X1 forms an angle comprised between 0° and about fifteen degrees with the pivot axis Y. More specifically, the entire lower leg structure 2 presents a vertical plane P1 separating a lower leg structure into two equal internal and external parts; this plane P1 forms an angle comprised between zero degrees and about fifteen degrees with the median plane M of the exoskeleton 1 and therefore with the direction of walking, so that the foot structures 4 of the exoskeleton 1 diverge slightly when the exoskeleton 1 is standing and at rest. The first pivot axis X1 is then perpendicular to this plane P1. For example, the first pivot axis X1 may form an angle comprised between 6° and 10°, typically 8°, with the pivot axis Y.

In other words, if we consider that the lower structure leg 2 extends in a main direction defining a longitudinal axis Z, the first pivot axis X1 is in a plane substantially perpendicular to this longitudinal axis and extends substantially perpendicular to the walking direction of the exoskeleton 1 and perpendicular to the plane P1.

In practice, it is noted that the longitudinal axis Z of the lower leg structure 2 has an angle comprised between 90 and 95° with the support plane 40 of the foot structure 4, and thus the ground, when the exoskeleton 1 is standing and at resting position. The first pivot axis X1 is thus comprised in a plane substantially parallel to the ground, when the exoskeleton 1 is standing and at rest.

The first pivot axis X1 preferably extends at the medial malleolus and the lateral malleolus of the foot of the user wearing the exoskeleton 1.

The second pivot axis X2 extends in turn in a plane perpendicular to the first pivot axis X1 and forms with the support plane 40 an angle α comprised between 30° and 60° when the exoskeleton 1 is standing and at rest. This second pivot axis X2 substantially corresponds to the Henke's axis of the ankle of a human and allows the foot structure 4 of the exoskeleton 1 to perform movements of inversion and eversion. Specifically, when the plane P1 and the median plane are not congruent, the second pivot axis X2 corresponds to the projection of the Henke's axis in the plane P1.

Preferably, the second pivot axis X2 forms an angle α comprised between 40° and 50° with the support plane 40 when the exoskeleton 1 is standing and at rest, preferably of the order of 45°. These angular values make it possible to improve the ergonomics of the exoskeleton 1 closer to the actual angle of the projection of the Henke's axis of the user wearing the exoskeleton 1 in the plane P1. The exoskeleton 1 is therefore more stable and the risk of injury to the user, who may be affected by a motor deficiency and therefore may not control the movements of a body part in the exoskeleton 1, are reduced.

In order to control the movements of the foot structure 4 relative to the lower leg structure 2, the exoskeleton 1 may in particular comprise two actuators 60 in parallel, fixed between the foot structure 4 and the lower leg structure 2 and configured to control the angular position of the foot structure 4 about the first and the second pivot axis X2 of the mechanical ankle link 5. The actuators 60 in parallel may in particular extend from both sides of the lower leg structure 2 and of the foot structure 4.

Here, the parallel actuators 60 extend facing an inner portion and an outer portion of the calf of the user wearing the exoskeleton 1.

The implementation of two actuators 60 in parallel has the advantage of allowing the accumulation of the power of several motors on a single actuating movement. Such power may be advantageous when a large torque is required in a short time interval, for example to prevent a fall of the exoskeleton 1 and its user. Furthermore, the actuators 60 are fixed relative to the lower leg structure 2, which allows a reduction of the mass in motion relative to the lower leg structure, and therefore its inertia.

Figure 5:
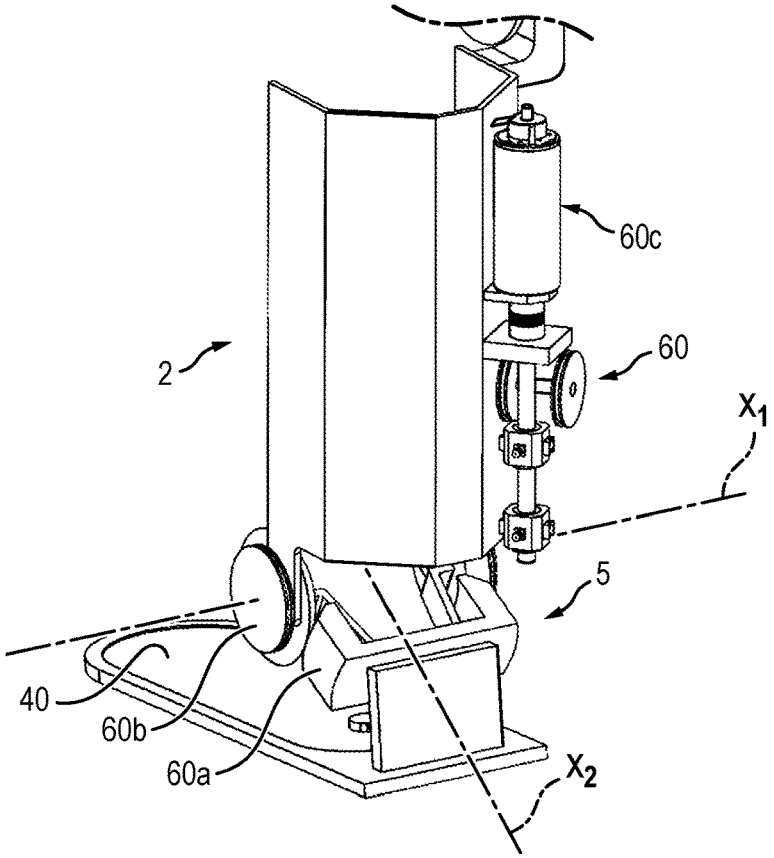
FIG. 5 is a simplified rear three-quarter view of a second embodiment of a foot structure and of a lower leg structure according to the invention, in which a single actuator has been shown.

In a first embodiment shown schematically in FIG. 5, the parallel actuators 60 may comprise two gears 60, preferably with parallel axes. In this embodiment, each of the gears 60 may in particular comprise:

- a drive meshing member 60*a*, mounted on the lower leg structure 2 and coaxial with the first pivot axis X1. The drive meshing member 60*a* may be of the type spur, helical or double helical bevel gear or gear wheel.
- an output meshing member 60*b*, mounted on the foot structure 4 and having a rotation axis parallel to the first pivot axis X1 and a rotation axis relative to the second pivot axis X2. The output meshing member 60*b* may also be of the type spur, helical or double helical bevel gear or gear wheel.

In order to reduce the size of the actuators 60, the drive meshing member 60*a* preferably comprises a gear wheel, while the output meshing member 60*b* may comprise a gear rim sector.

The gears 60 are preferably disposed facing the medial malleolus and the lateral malleolus of the foot of the user wearing the exoskeleton 1.

Each gear 60 is also rotated by a dedicated motor 60*c*. Typically, the motors 60*c* are fixed to the lower leg structure 2 and may be positioned facing the calf of the user, when wearing the exoskeleton 1.

To limit the lateral dimensions of the actuators 60, the motors are preferably offset relative to the gears 60 and drive their drive meshing member 60*a* associated with a drive system of the pulley-belt type.

Reduction mechanisms may further be provided between each motor 60*c* and the associated drive meshing member 60*a*. Preferably, the reduction mechanisms are placed between the motors 60*s* and the transmission mechanisms, to reduce the bulk of each actuator 60.

In a second embodiment, the actuators 60 parallel may each comprise a linear actuator 62 and a connecting rod 80. To this end, the linear actuator 62 may in particular be mounted fixed to the lower leg structure 2, while the connecting rod 80 may be mounted, on the one hand, on the linear actuator 62 by means of a mechanical link 82 and on the other hand, on the foot structure 4 by means of a ball joint link 84, so that translation of the linear actuator 62 causes a rotation of the connecting rod 80 relative to the foot structure 4.

This embodiment has the advantage of being structurally simple, low in weight and compact. The transmission of the movement of the actuators 60 is further carried out directly through the connecting rods 80 that are able to withstand the forces applied by the motor and the reaction of the foot structure 4 without the need for much bulk.

Each linear actuator 62 may comprise a cylinder 62, driven by an associated motor 63.

The cylinder 62 may in particular be of the type screw-nut 66 or ball screw and comprise for this purpose a threaded rod 64 rotated by the motor 63 and a nut 66 rotationally fixed relative to the lower leg structure 2. A ball screw has also the advantage of being reversible and having good performance.

In this case, each of the cylinders 62 may be associated with an encoder 20, fixed preferably in parallel to the motors 63 to reduce their size. The transmission of the rotation of the motor 63 shaft to the associated encoder 20 may then be performed using a system of the pulley-belt type to preserve the efficiency of the motor 63 while minimizing the clearance and the noise in the mechanism and withstand high rotation speeds.

The connecting rod 80 may then be mounted on the nut 66 so that a translation of the nut 66 causes a translation of the end of the connecting rod 80 which is fixed to the nut 66 using the mechanical link 82.

To avoid the application of transverse forces to the threaded rod 64 of the cylinder 62 which may block or damage the latter, the nut 66 may be mounted on a slide 68 which is fixed to the lower leg structure 2.

The slide 68 may in particular comprise a guide rail 69 fixed to the lower leg structure 2 and a carriage 70 movable in translation along the guide rail 69. The nut 66 is then fixed to the carriage 70, so that the rotation of the threaded rod 64 relative to the nut 66 causes the translation of the nut 66 and the carriage 70 along the guide rail 69 of the slide 68. It will be noted that the nut 66 and the carriage 70 may achieve various movements, especially in the case where the nut 66 is not recessed on the carriage 70. This is notably the case of the embodiment illustrated in FIG. 6*b*.

To compensate for any positioning errors between the motor 63 and the threaded rod 64, between the threaded rod 64 and the nut 66 and/or between the nut 66 and the slide 68 which might damage the cylinder 62, the actuators 60 further comprise means adapted to compensate for these potential errors.

Figure 6A:
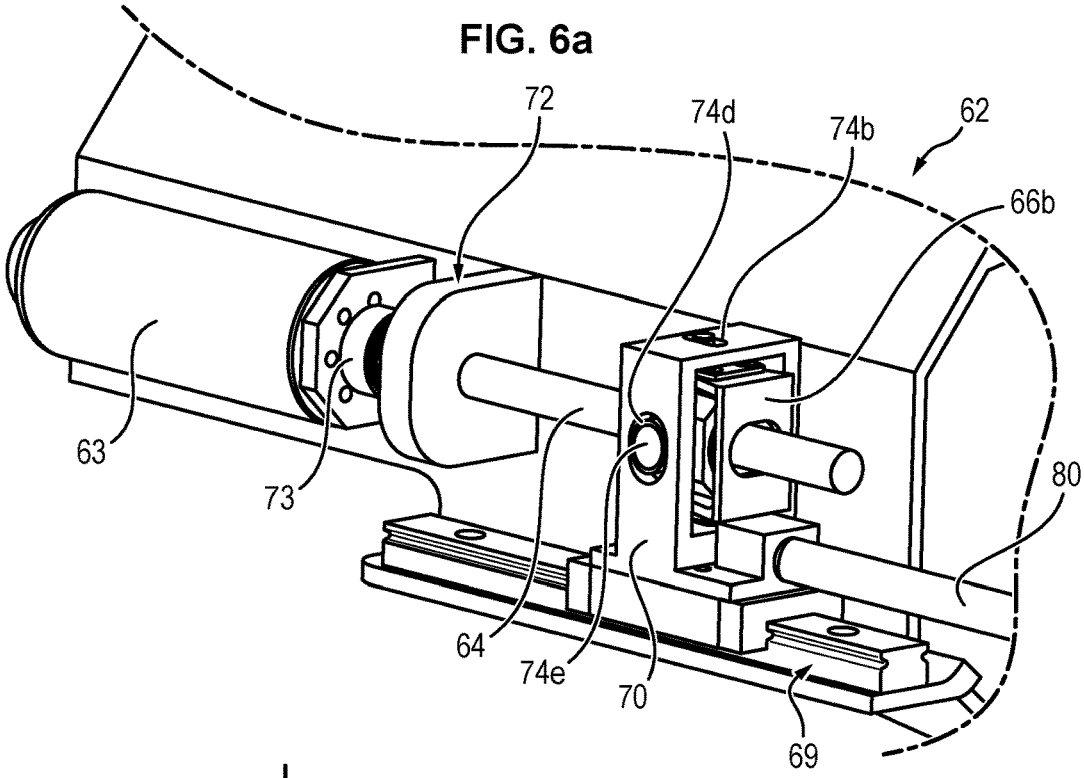
FIG. 6*a* is a perspective view of a first embodiment of an actuator that may be used for the structures of FIG. 2.
Figure 6B:
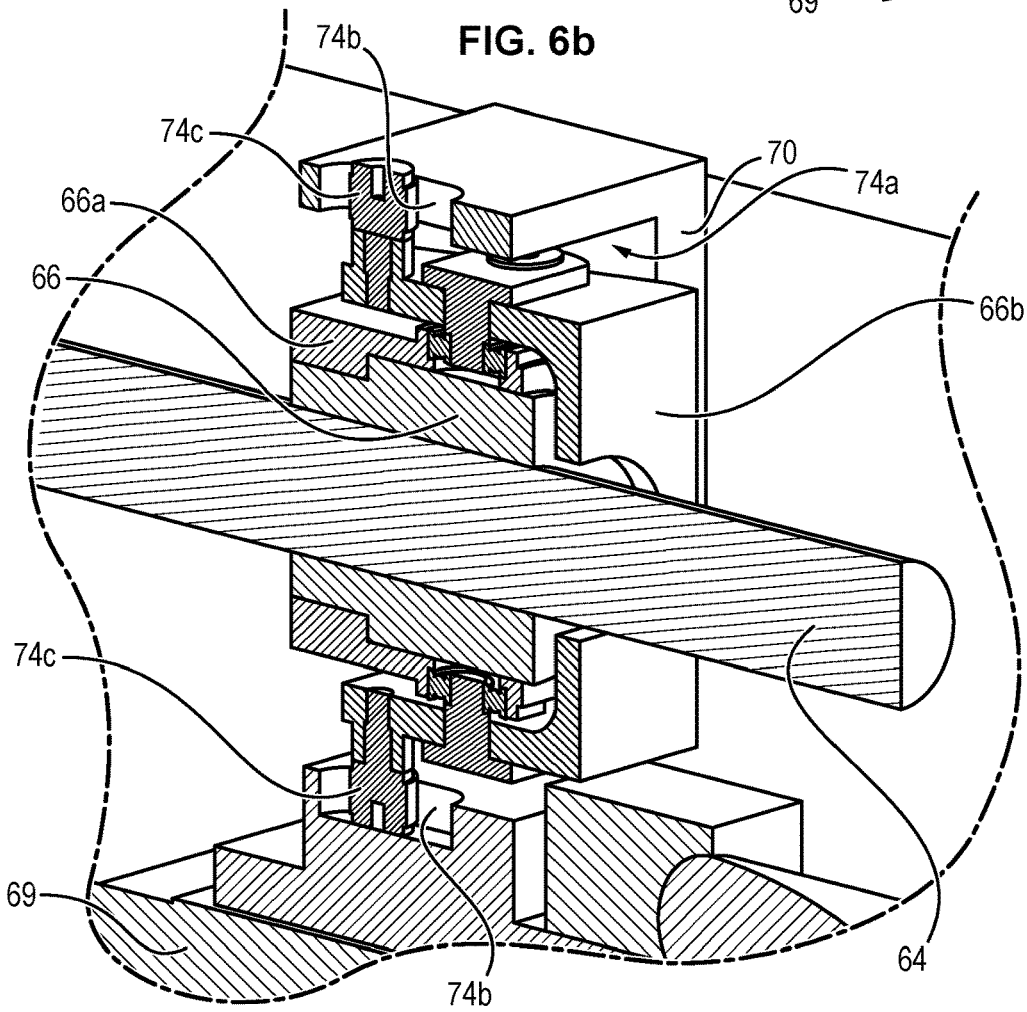
FIG. 6*b* is a sectional view of a portion of FIG. 6*a*.

To this end, according to a first embodiment illustrated in FIGS. 6*a* and 6*b*, the actuator 60 may comprise a rigid bearing 72 fixed between the output shaft 63*a* of the motor 63 and the threaded rod 64, in combination with flexible coupling means 73 of the threaded rod 64 with the output shaft 63*a* of the motor 63. such rigid bearing 72 having the advantage of taking up the loads which are not supported by the single bearing of the motor 63 and to ensure the guiding in rotation of the threaded rod 64.

In this embodiment, the nut 66 may then be fixed to the carriage 70 via a mechanical link 74 capable of blocking rotation and translation of the nut 66 along the main axis of the threaded rod 64 relative to the carriage 70.

For example, the carriage 70 may comprise walls defining a chamber 74*a* configured to receive the nut 66 and be traversed by the threaded rod 64. A first port 74*b*, configured to receive an anti-rotation pin 74*c* projecting from the nut 66, may be formed in one of the walls of the chamber 74*a* Preferably, two ports 74*b*, associated with two anti-rotation pins 74*c* of the nut 66 are formed in walls facing the chamber 74*a* to improve the rotational locking of the nut 66. In an embodiment, the two ports 74*b* and the two anti-rotation pins 74*c* are distributed symmetrically relative to the axis of the threaded rod 64 so as not to generate parasitic force on this threaded rod 64.

Where appropriate, these two ports 74*b* may also participate in transmission of translational movement of the nut 66 to the carriage 70. Alternatively, two housings 74*d*, each configured to receive a roller 74*e* projecting from the nut 66 to drive the carriage 70 in translation relative to the guide rail 69 may be formed in the walls of the chamber 74*a*. In this variant embodiment, the ports 74*b* receiving the anti-rotation pins 74*c* may then be oblong in shape, the major axis of the ports 74*b* being aligned with the axis of the threaded rod 64, to form a clearance with the walls of the chamber 74*a* and compensate for misalignment that may block translation of the nut 66 relative to the threaded rod 64. In one embodiment, the two housings 74*d* and the two rollers 74*e* are distributed symmetrically relative to the axis of the threaded rod 64 so as not to generate parasitic force on this threaded rod 64.

FIGS. 6*a* and 6*b* illustrate an exemplary embodiment of such a mechanical link. In this embodiment, the chamber 74*a* is substantially rectangular and comprises a bottom wall, facing the guide rail 69, a top wall, opposite the bottom wall, and two side walls which connect the bottom wall and the top wall. Two ports 74*b*, which here have the form of an elongated slot, are formed respectively in the bottom wall and the upper wall of the chamber 74*a* of the carriage 70. Housings 74*d*, also oblong in shape, are also formed in the side walls of the chamber 74*a*.

The mechanical link 74 further comprises a ring 66*a*, applied and fixed integrally to the nut 66, for example by fitting, and an auxiliary carriage 66*b*, pivotally mounted on the ring 66*a*. The auxiliary carriage 66*b*, the ring 66*a* and the nut 66 are housed in the chamber 74*a* of the carriage 70.

The auxiliary carriage 66*b* comprises two opposite anti-rotation pins 74*c* projecting and configured to be housed in the ports 74*b* formed in the upper and bottom walls of the chamber 74*a* of the carriage 70 to prevent rotation of the auxiliary carriage 66*b* relative to the carriage 70, upon rotation of the threaded rod 64. the pivot axis of the auxiliary carriage 66*b* relative to the ring 66*a* is substantially parallel to the axis connecting anti-rotation pins 74*c*.

The ring 66*a* is also equipped with rollers 74*e* configured to penetrate the housing 74*d* of the carriage 70 and drive the carriage 70 of the slide 68 in translation.

Figure 7:
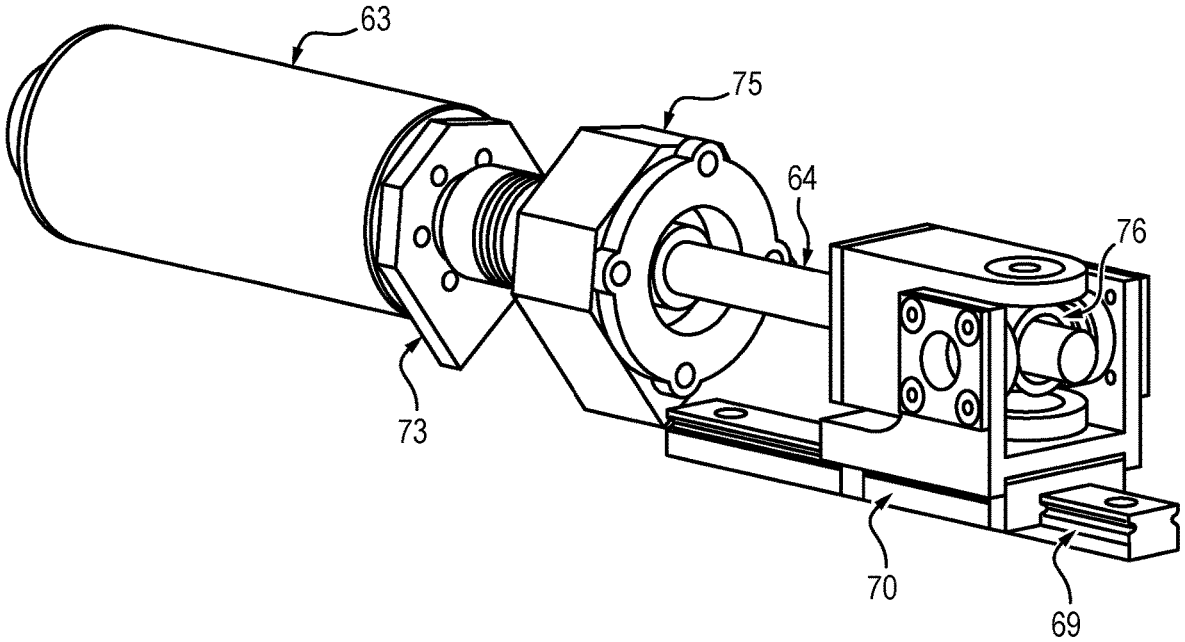
FIG. 7 is a perspective view of a second embodiment of an actuator that may be used for the structures of FIG. 2.

According to a second embodiment illustrated in FIG. 7, the actuator 60 comprises a pivot joint 75, interposed between the output shaft 63*a* of the motor 63 and the threaded rod 64, associated with a mechanical link 76 that blocks rotation of the nut 66 relative to the threaded rod 64 and allow translation of the nut 66 relative to the lower leg structure 2, and therefore to the guide rail 69.

The mechanical link 76 may especially comprise a universal joint.

The pivot joint 75 may comprise a self-aligning ball or roller bearing, for example a self-aligning bearing of type 2600-2RS. A self-aligning bearing 75 allows in fact relative movement of the rings housing the rolling elements, and thus allows isostatic guiding of the threaded rod 64 despite the presence of misalignment between the threaded rod 64 and the guide rail 69.

Flexible coupling means 73 of the threaded rod 64 with the output shaft 63*a* of the motor 63 may also be provided to compensate for any faults in alignment of the threaded rod 64 and of the output shaft 63*a* of the motor 63.

The cylinder 62 is preferably of the ball screw type comprising ball bearings instead of bearing bushings to reduce forces related to sliding.

This second embodiment has the advantage of being less bulky and less complex than the first embodiment and reducing parasitic forces that may be applied to the nut 66 due to friction at the line contact between the rollers 74*e* and the carriage 70 of the first embodiment.

Figure 8A:
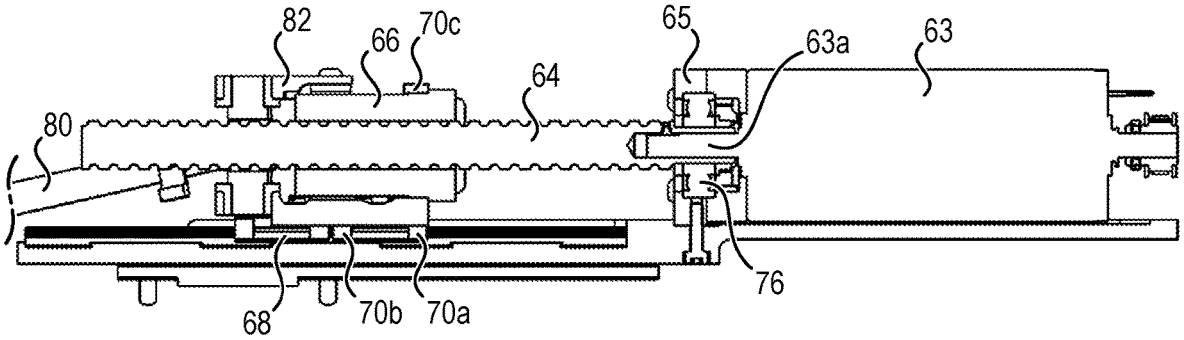
FIG. 8*a* is a sectional view of a third embodiment of an actuator that may be used for the structures of FIG. 2.
Figure 8B:
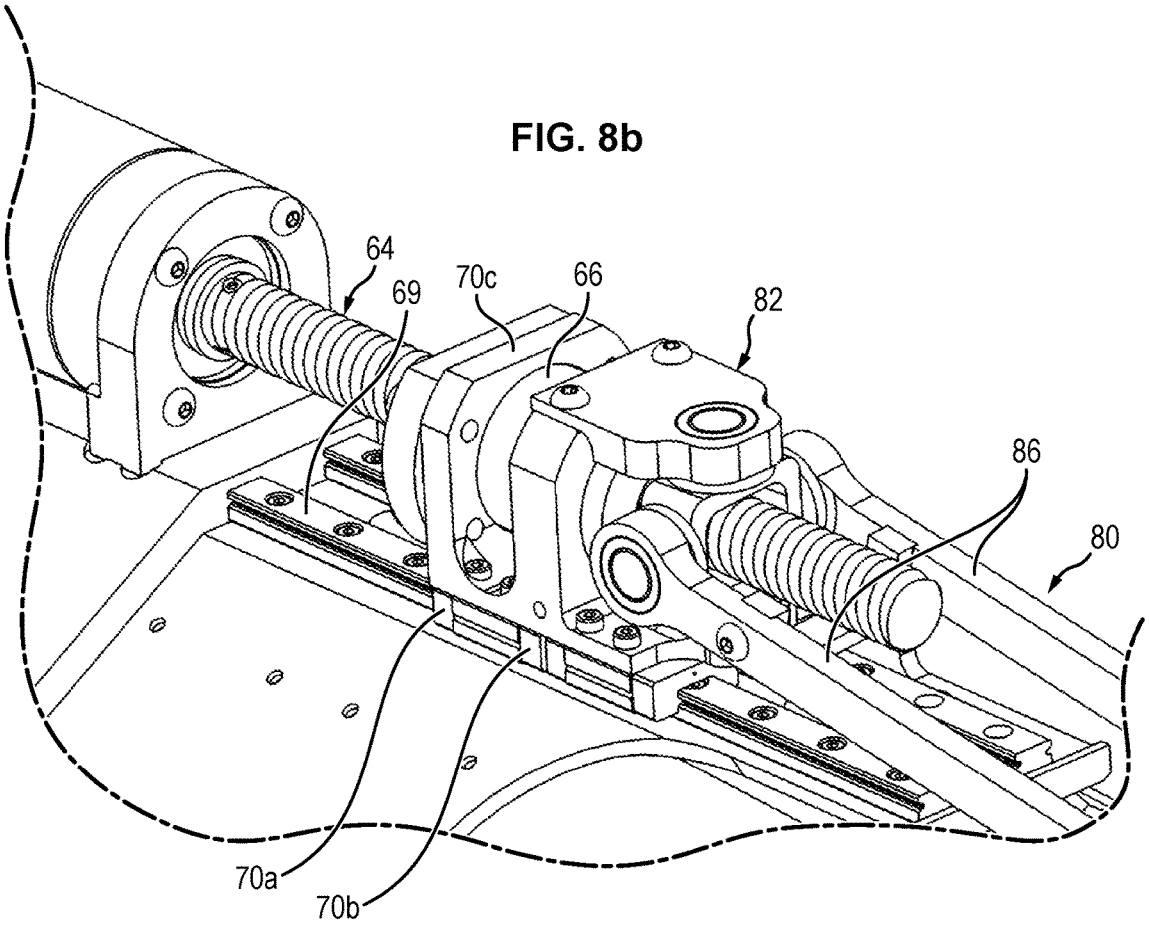
FIG. 8*b* is a perspective view of the actuator of FIG. 8*a*.
Figure 9:
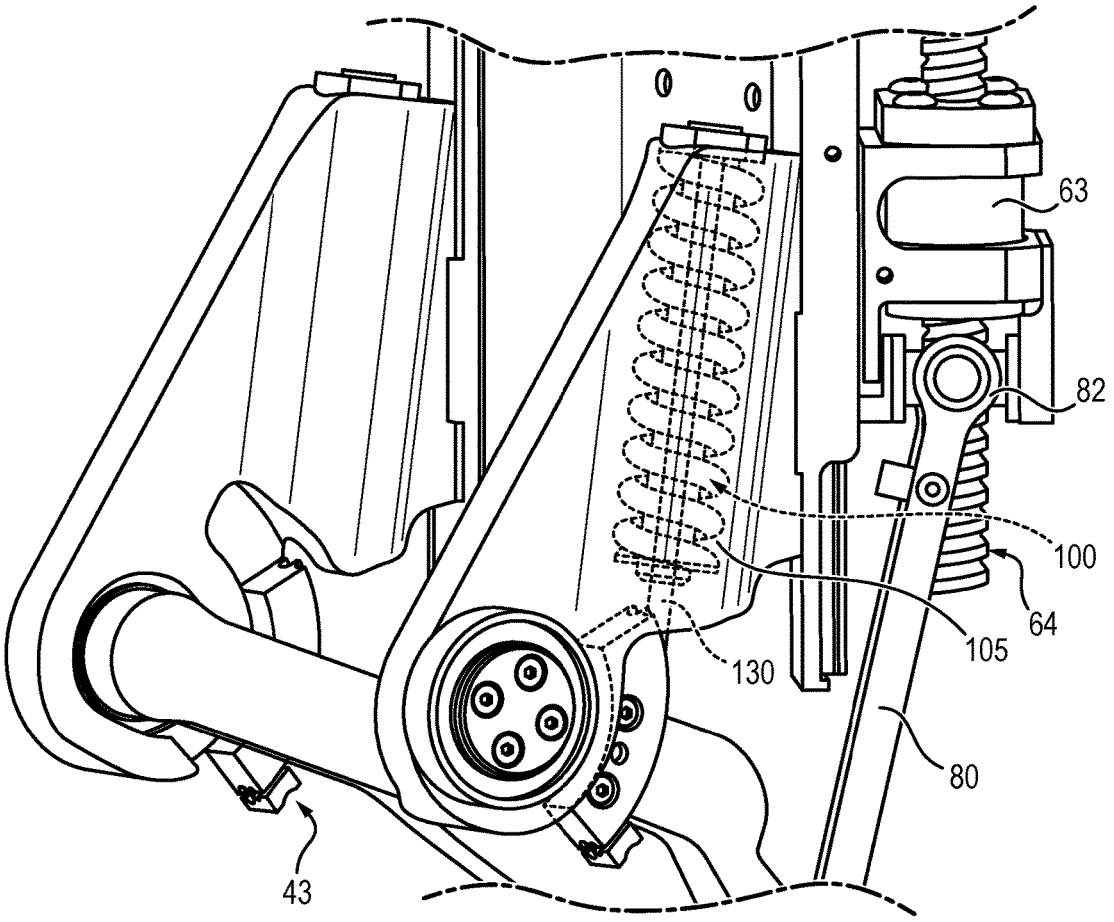
FIG. 9 is a detail of FIG. 1*b*, on which is shown an exemplary embodiment of a spring assembly.
Figure 10:
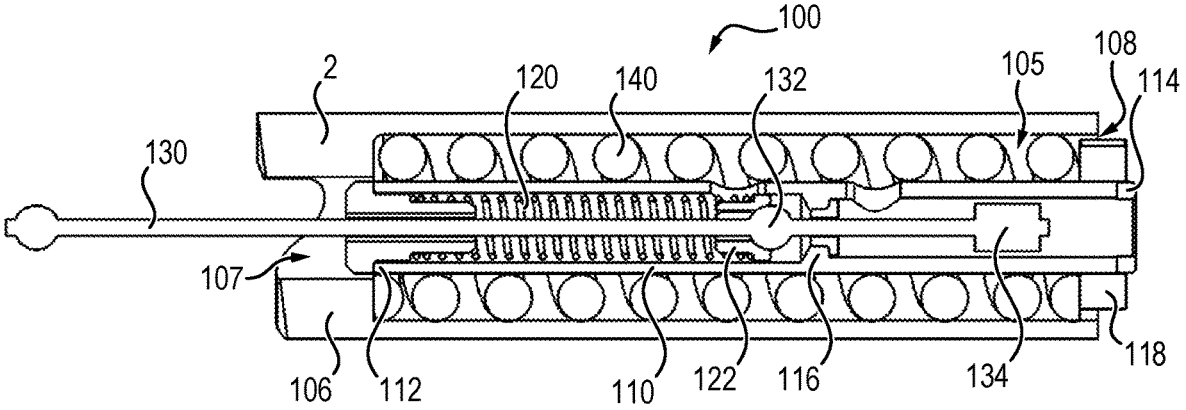
FIG. 10 is a sectional view of the spring assembly of FIG. 9.

According to a third embodiment illustrated in FIGS. 8*a* and 8*b*, the actuator 60 comprises a simple mechanical bearing 76 interposed between the output shaft 63*a* of the motor 63 and the threaded rod 64, while the nut 66 is embedded on the carriage 70 of the slide 68, for example by screwing or welding.

A simple mechanical bearing 76, is understood to be a mechanical link of the pivot type having two coaxial rings, between which are placed rolling elements such as balls, rollers, bearing bushings, etc. and which are held spaced apart from each other by a cage. A mechanical bearing 76 that may be implemented in an actuator 60 in accordance with this embodiment comprises for example, a bearing of the 629-ZZ type.

The mechanical bearing 76 preferably has misalignment comprised between five minutes of arc and fifteen minutes of arc, typically about ten minutes of arc to compensate for misalignment between the threaded rod 64 and the bearing 76 housing, for example the part 65. The Applicant has in fact perceived that such a mechanical bearing 76, which is less complex, less bulky and less expensive than a self-aligning bearing 75, is in fact sufficient to prevent damage to the actuator 60 due to parts manufacturing defects and particularly misalignment between the threaded rod 64 and the output shaft 63*a* of the motor 63. In fact, a misalignment of few minutes of arc is possible between the threaded rod 64 and the output shaft 63*a* of the motor 63 leaving an intentional clearance between the output shaft 63*a* and the bore of the threaded rod 64 in which the output shaft is inserted. Transmission of the rotation between the shaft 63*a* and the threaded rod 64 may then be achieved by obstacle allowing the misalignment, for example by means of a cotter in a groove. This mechanical bearing 76 eliminates the use of flexible coupling means between the output shaft 63*a* and the threaded rod 64, thanks to the slight defect in coaxiality therefore admissible between the axis of the output shaft 63*a* and the axis of the threaded rod 64. Finally, unlike the second embodiment, which requires placing the self-aligning bearing 75 at a distance from the flexible coupling means 73 and that is therefore more bulky along the axis the threaded rod 64, the mechanical bearing 76 may be placed directly at the output shaft 63*a* of the motor 63.

For example, the mechanical bearing 76 may comprise a ball bearing with a misalignment of about ten minutes of arc, as the ball bearing 629-ZZ.

Compared with the second embodiment, the embedding of the nut 66 on the carriage 70 of the slide 68 has the advantage of greatly limiting the radial size of the actuator 60 at the nut 66, and structurally simplify the actuator 60 by limiting the number of parts required. Fastening the nut 66 on the slide 68 by means of a universal joint further creates a large distance between the nut 66 and the slide 68 capable of generating a large lever arm: replacing this universal joint 76 by an embedded connection and reduces forces applied by the threaded rod 64 on the slide 68.

Replacement of the universal joint 76 by an embedded connection is made possible through the alignment defects tolerated by the bearing 76 and possible control of manufacturing defects of the mechanical parts.

To reduce parasitic forces, in particular the transverse forces that may be transmitted by the nut 66 and the slide 68 to the threaded rod 64, and reduce the risk of locking the actuator 60, the carriage 70 may comprise at least two sliders 70*a*, 70*b*, mounted movable in translation on the guide rail 69 of the slide 68, on which is integrally fixed a connecting part 70*c*. For example, the carriage 70 may comprise two pairs of sliders 70*a*, 70*b* and the slide may comprise two guide rails 69, each pair of sliders 70*a*, 70*b* being mounted on a guide rail 69 associated with the slide 68.

The nut 66 may then be embedded on the connecting part 70*c*, at the first slider 70*a*, while the connecting rod 80 may be mounted on the connection part 70*c* at the second slider 70*b*. In this way, the transverse forces applied by the connecting rod 80 on the actuator 60 are not transmitted directly to the threaded rod 64, but are partly taken up by the two sliders 70*a*, 70*b* of the carriage 70, which damp them while guaranteeing the displacement of the connecting part 70*c*, and therefore the transmission of movements of the nut 66 to the connecting rod 80.

In a variant of this embodiment, the nut 66 may be fixed to the slide 68 via a pivot link, instead of the embedded connection. Such a configuration makes it possible to already reduce the radial distance between the threaded rod 64 and the slide 68. However, the Applicant noticed that the constraints in terms of manufacturing accuracy are substantially the same when the mechanical link is a pivot link or an embedded connection: thus, an embedded connection is preferred, particularly when the transverse forces are partly taken up by the carriage 70 equipped with two sliders 70*a*, 70*b*.

Finally, for the sake of better withstanding the parasitic forces which may be applied to the threaded rod 64, in particular by the connecting rod 80, the diameter of the threaded rod 64 may be increased in comparison with the diameter of the threaded rods of the first two embodiments, which eliminates purely isostatic solutions. Thus, the diameter of the threaded rod may for example be of the order of 10 mm in the first two embodiments, while it may be 12 mm in the third embodiment.

Note that such an increase in the diameter of the threaded rod 64 does not mean an increase in the size of the actuator 60. While increasing the diameter of the threaded rod 64 involves an increase of the pitch of the rod 64 and thus of the stroke of the nut 66, with the same motor 63. However, the implementation of the simple mechanical bearing 76 instead of the flexible coupling means 73 and the self-aligning bearing 75 permits, in turn, to reduce the axial length of the actuator 60 by reducing the space required between the output shaft 63*a* of the motor 63 and the threaded rod 64.

Whatever the embodiment, the connecting rod 80 may be fixed to the nut 66 by means of a mechanical link 82 that may comprise a pivot link, two pivot links of substantially perpendicular axis, a ball joint link 84 or a finger ball joint link such as a universal joint.

In the example shown in the figures, the connecting rod 80 is for example fixed to the second portion of the carriage 70 with a universal joint 82. This embodiment makes it possible to align the center of the mechanical link between the connecting rod 80 and the cylinder 62 with the axis of the threaded rod 64, and thus reduce the moments applied by the mechanism on the slide 68.

Furthermore, the connecting rod 80 may be fixed to the foot structure 4 by means of a ball joint link 84. For congestion issues and transmission of the forces of the actuators 60 to the foot structure 4, the connecting rod 80 is preferably fixed in a posterior area of the foot structure 4, for example an area of the foot structure 4 configured to be positioned facing the heel of the user wearing the exoskeleton 1.

Finally, the connecting rod 80 may comprise two arms 86, rigidly joined together at the mechanical link with the cylinder 62 and the ball joint link with the foot structure 4. This embodiment makes it possible for the connecting rod 80 to follow the movement of the nut 66 during its translation towards the motor 63 without the risk of coming into contact with the threaded rod 64, which may then be positioned between the two arms of the connecting rod 80. the presence of the two arms further has the advantage of allowing a better absorption of forces in tension and compression applied to the connecting rod 80.

The foot structure 4 may especially comprise an intermediate part 42 mounted in rotation with passive pivot links 44, 46 on the foot structure 4 and on the lower leg structure 2, to allow the ankle structure to pivot about the two pivot axes, on control of the parallel actuators 60.

More specifically, the intermediate part 42 may be mounted in rotation about the first pivot axis X1 on the lower leg structure 2, and about the second pivot axis X2 on the foot structure 4, through passive pivot links 44, 46.

The passive pivot link 44 about the first pivot axis X1 may especially comprise bearings with tapered rolling elements in O or X, centered on the first pivot axis X1 and extending on both sides of the foot structure 4. such bearings in O or X have a low lateral bulk and thus do not form a hindrance for the user when walking with the risk of coming into contact with obstacles. For example, two bearings of the 61904-ZZ type may be implemented.

This first passive pivot link 44 thus enables the actuators 60 to rotate the foot structure 4 about the second pivot axis X2 without risk of locking the structure at the first pivot axis X1.

The passive pivot link 46 about the second pivot axis X2 preferably comprises a single bearing insofar as the insertion of two bearings from both sides of the second pivot axis X2 interferes with the foot of the user wearing the exoskeleton 1. This second passive pivot link 46 may for example comprise a combined needle bearing with thrust ball bearing of the NKIB type.

In this way, the actuation of one and/or the other of the actuators 60, particularly in the case of a cylinder 62 associated with a connecting rod 80, causes rotation of the foot structure 4 without risk of blocking.

Here, the foot structure 4 comprises a fixing part 48, embedded on the foot structure 4 and supporting the passive pivot link 46 about the second pivot axis X2, the intermediate part 42 being mounted in rotation on the fastening part 48 about the second pivot axis X2. In the embodiment illustrated in the figures, the connecting rods 80 are fixed to this fastening element 48 via the ball joint links 84, on both sides of the passive pivot link 46. Such a configuration thus makes it possible easy to attach the connecting rods 80 on the foot structure 4, in an area adjacent to the heel of the user, without thereby hindering the introduction of the users foot into the foot structure 4.

To enable the mounting of the intermediate part 42 in rotation about the first pivot axis X1 which extends at the malleoli of the user wearing the exoskeleton 1, the intermediate part 42 may have a U-section, configured to bypass the ankle of the user when the foot is placed in the foot structure 4, while allowing the passive pivot links 44, 46 of the intermediate part 42 to face its malleoli. Of course, it is understood that the intermediate part 42 may indifferently be carried out in one single piece, or alternatively comprise several elements which are assembled to form a single piece.

An example of operation of the exoskeleton 1 will now be described, in the case where the actuators 60 comprise a cylinder 62 of the type ball screw or screw-nut 66 and a connecting rod 80. The two cylinders 62 are identical, and comprise therefore threaded rods 64 of the same length and of the same pitch, a same motor 63 and identical rods 80. The threaded rods 64 may be rotated counterclockwise or clockwise.

When the two threaded rods 64 are moved equally and simultaneously so as to translate the nut 66 towards the free end of the rods 64, the end of the connecting rods 80 which is fixed to the nut 66 is moved towards the foot structure 4. the opposite end of the connecting rods 80 then applies a force to the foot structure 4 which tends to pivot the foot structure 4 about the first pivot axis X1 only. This movement allows the foot of the user wearing the exoskeleton 1 to flex.

When the two threaded rods 64 are moved equally and simultaneously, in opposite directions of rotation, so as to translate the nut 66 towards the motor 63, the end of the connecting rods 80 which is fixed to the nut 66 is moved in the direction opposite to the foot structure 4, to the mechanical knee link 3. The opposite end of the connecting rods 80 then applies a force to the foot structure 4 which tends to pivot the foot structure 4 about the first pivot axis X1 only, in the opposite direction, allowing the foot of the user to be extended.

When the two threaded rods 64 are moved in different ways, for example one counterclockwise and the other clockwise, one of the connecting rods 80 is displaced in the direction of the foot structure 4 while the other of the connecting rods 80 is displaced in the opposite direction, which allows rotation of the foot structure 4 about the second pivot axis X2 thus performing movements of inversion and eversion, in the direction of rotation of each threaded rod 64. Of course, the stroke of the two nuts 66 may be identical or different in order to better adjust the orientation of the foot and, if necessary, inducing a rotation of the foot structure 4 about the first and/or the second pivot axis X1, X2.

The control of the foot structure 4 may be made very accurately, depending on the direction of rotation and of the stroke of each threaded rod 64.

The exoskeleton 1 may also comprise a system 100 configured to relieve the motors 60*c*, 63 of the actuators 60 to provide the necessary impetus to the detachment of the foot at the end of the standing phase. Indeed, at the end of the standing phase, a large torque is necessary about the pivot axis X1 to provide the walking motion of the exoskeleton 1.

Thus, the system 100 may comprise a compression spring assembly, fixed, on the one hand, to the intermediate part 42 and on the other hand, to the lower leg structure 2, which is configured to bias the foot structure 4 during the standing phase only, and in particular during detachment of the foot.

To this end, the spring assembly 100 may for example comprise a hollow body 110 comprising a first 112 and a second 114 end and housing an elastically deformable member 120 having a first stiffness.

The hollow body 110 is mounted in a housing 105 formed in the lower leg structure 2. The housing comprises a bottom 106 and a mouthpiece 108, the first end 112 of the hollow body 110 being facing the bottom 106. The bottom 106 further comprises a through hole 107. the mouthpiece 108 may be open and lead to the exterior, or be closed by a cover.

The elastically deformable member 120 may in particular comprise a spring. The hollow body 110 may be of cylindrical or tubular shape.

The spring 120 is mounted in the hollow body 110 so as to abut against its first end 112 and is connected to a fastening element 130 passing through the housing 105, the hollow body 110 and the spring 120 and projecting from its first end 112 and from the through hole 107. This fastening element 130 is also fixed to the foot structure 4, for example at the intermediate part 42.

In one embodiment, the fastening element 130 is flexible and may for example comprise a cable. The flexible nature makes it possible for the fastening element 130 to adjust to the rotary movements of the foot structure 4 and not transmit forces other than tensile forces to the spring assembly 100. In what follows, the invention will be more particularly described in the case of a fastening element 130 comprising a cable. This however is not limiting, the cable being only one possible embodiment of the fastening element.

The aim is to relieve the motors 60*c*, 63 during the standing phase and therefore when the foot is flexed, the cable 130 is fixed to a rear area of the foot structure 4, preferably in an area between the first pivot axis X1 and the heel of the foot structure 4. In particular, the cable 130 may be fixed to the intermediate part 42, for example by means of a part 43 fixed to the intermediate part 42 and configured to block the cable 130 relative to the intermediate part 42.

The spring 120 housed in the hollow body 110 is preferably coaxial with the hollow body 110.

The connection between the spring 120 and the cable 130 may be achieved by gluing or welding. Alternatively, the spring 120 may comprise a locking part 122 fixed to a portion of the spring 120 which extends away from the first end 112 of the hollow body 110, while the cable 130 has a thickened portion 132 configured to abut against the locking part 122. Pulling on the cable 130 in a direction opposite to the second end 114 of the hollow body 110 thus has the effect of contacting the thickened portion 132 with the locking part 122 and compressing the spring 120.

The stiffness and the length of the spring 120 are chosen according to the length of the cable 130 and the angular range that may be traveled by the foot structure 4 relative to the lower leg structure 2 so as to ensure that the 130 cable remains tensioned at all times, whatever the position of the foot structure 4 relative to the lower leg structure 2, and therefore regardless of the walking phase of the exoskeleton 1. This makes it possible to improve the reaction time of the spring assembly 100 by avoiding any jerks which could be uncomfortable for the user.

The cable 130 further comprises a stopper 134, fixed to or formed integrally with the cable 130 between the thickened portion 132 and the end of the cable 130 that is housed in the hollow body 110, configured to cooperate with a protrusion 116, fixed in the hollow body 110 and forming an obstacle to the stopper 134. the protrusion 116 may for example have the shape of a collar. The stopper 134 may itself be fixed to the end of the cable 130.

Finally, the spring assembly 100 comprises an effective spring 140, positioned in the housing 105 about the hollow body 100. The effective spring 140 is supported and compressed between the bottom 106 of the housing 105 of the lower leg structure 2 and a supporting stop 118 formed on the hollow body 110. The effective spring 140 and the hollow body 110 are thus coaxial, the hollow body 110 forming a support for the effective spring 140. The supporting stop 118 of the hollow body 110 may in particular be fixed near its second end 114, and comprise a bolt in order to allow the possible displacement of the supporting stop 118 relative to the hollow body 110 and hence the adjustment of the stiffness of the effective spring 140.

In this way, when a force in tension is applied to the cable 130, the thickened portion 132 is moved in the hollow body 110 and compresses the spring 120 until the stopper 134 comes into contact with the protrusion 116 and blocks the relative movement of the cable 130 and of the spring 120 relative to the hollow body 110. Thus, the cable 130 is locked in translation by the protrusion 116 and may no longer compress the spring 120. If the foot structure 4 continues to pull on the cable 130, the assembly formed by the cable 130, the hollow body 110 and the supporting stop 118 move while compressing the spring 140 between the supporting stop 118 and the bottom 106 of the housing 105, the housing 105 being integral in movement with the lower leg structure 2.

The spring assembly 100 may be dimensioned so that this configuration corresponds to the case where the foot structure 4 initiates the support phase on the ground.

The stiffness of the effective spring 140 is preferably greater than the stiffness of the spring 120 housed in the hollow body 110, to ensure that only the spring 120 housed in the hollow body 110 compresses as the stopper 134 does not come into contact with the protrusion 116. In this phase, it is indeed not necessary to relieve the motors 60*c*, 63. Then, once the stopper 134 abuts against the protrusion 116, the cable 130 applies a tensile force on the hollow body 110 which therefore tends to compress the effective spring 140, and thus to generate a torque on the foot structure 4 about the first pivot axis X1 so as to tension the foot, that relieves the motors 60*c*, 63 of the actuators 60 and helps provide the impetus to the detachment of the foot during a walking cycle.

It is understood of course that other elastic members having stiffness may be implemented, instead of the spring 120 housed in the hollow body 110 and/or of the effective spring 140.

Moreover, the compression spring assembly 100 may be implemented regardless of the exoskeleton 1 described herein, on any device requiring the application of a force only during certain operating phases of the device. The description of this spring assembly 100 thus applies to any device comprising a first part to which may be fixed the hollow body 110, which carries the effective spring 140, and a second part, movable relative to the first part and to which may be fixed the other end of the effective spring 140 to apply a force. The fastening element 130 is then fixed to the second part so as to apply a force to the spring 120 housed in the hollow body 110 when the second part is moved relative to the first, until it reaches a predefined threshold from which the fastening element, the spring 120 and the hollow body 110 move jointly, only the effective spring 140 being biased and applying force on both parts.

The invention claimed is:

1. An exoskeleton comprising:

a foot structure comprising a support plane configured to receive a foot of a user, a lower leg structure configured to receive a lower portion of a user's leg, a mechanical knee link configured to connect the lower leg structure to an upper leg structure configured to receive an upper portion of a user's leg, the mechanical knee link having a pivot axis, and a mechanical ankle link, connecting the foot structure to the lower leg structure, the mechanical ankle link comprising a first pivot link having a first pivot axis, said first pivot axis being substantially parallel to the pivot axis of the mechanical knee link, the exoskeleton being characterized in that the mechanical ankle link further comprises a second pivot link having a second pivot axis, said second pivot axis extending in a plane perpendicular to the first pivot axis and forming with the support plane an angle comprised between 30° and 60° when the exoskeleton is standing and at rest.

2. The exoskeleton according to claim 1, wherein the second pivot axis forms an angle comprised between 40° and 50° with the support plane when the exoskeleton is standing and at rest, preferably of the order of 45°.

3. The exoskeleton according to claim 1 or 2, further comprising two actuators in parallel, fixed between the foot structure and the lower leg structure and configured to control an angular position of the foot structure about the first and the second pivot axis of the mechanical ankle link.

4. The exoskeleton according to claim 3, wherein the actuators are fixed in parallel on both sides of the lower leg structure.

5. The exoskeleton according to claim 3, wherein the actuators each comprise:

a linear actuator, mounted on the lower leg structure, and a connecting rod, mounted, on the one hand, on the linear actuator and on the other hand on the foot structure using a pivot joint, so that a translation of the linear actuator causes a rotation of the connecting rod relative to the foot structure.

6. The exoskeleton according to claim 5, wherein the linear actuators comprise a cylinder associated with a motor, preferably of the ball screw or screw-nut type.

7. The exoskeleton according to claim 6, wherein the cylinder comprises a threaded rod driven in rotation by the motor and a nut fixed in rotation relative to the foot structure, the connecting rod comprising one end mounted on the nut so that a translation of the nut causes a translation of the end of the connecting rod.

8. The exoskeleton according to claim 7, wherein each actuator further comprises at least one slide having a guide rail fixed to the lower leg structure, and a carriage, movable in translation along the guide rail, the nut being fixed to the carriage of the slide.

9. The exoskeleton according to claim 8, wherein the carriage comprises a first slider and a second slider, mounted movable in translation on the guide rail of the slide and connected integrally by a connecting part, the nut and the connecting rod being fixed to the connecting part of the carriage.

10. The exoskeleton according to claim 7, wherein a mechanical link between the nut and the connecting rod comprises a pivot link and a mechanical link between the connecting rod and the foot structure comprises a pivot joint.

11. The exoskeleton according to claim 10, wherein the mechanical link between the nut and the connecting rod comprises a universal joint, or two pivot links of substantially perpendicular axis.

12. The exoskeleton according to claim 7, wherein the cylinder further comprises a simple mechanical bearing interposed between an output of the motor and the threaded rod, said mechanical bearing having a misalignment comprised between five minutes of arc and fifteen minutes of arc, typically about ten minutes of arc.

13. The exoskeleton according to one of claim 1, wherein:

the first pivot link is positioned on the foot structure so as to face a medial malleolus and a lateral malleolus of a user wearing the exoskeleton and/or the second pivot link is positioned on the foot structure so as to face a heel or a user's Achilles tendon.

14. The exoskeleton according to one of claim 1, wherein the first pivot axis and the pivot axis of the mechanical knee link form an angle comprised between 0° and about fifteen degrees, preferably between 6° and 10°, for example 8°.

15. The exoskeleton according to claim 1, wherein the first pivot axis extends in a plane parallel to the ground when the exoskeleton is standing and at rest.

16. The exoskeleton according to claim 1, further comprising an intermediate part which is mounted, on the one hand, on the foot structure being free to rotate relative to the foot structure about the second pivot axis, and on the other hand, pivotally mounted about the first pivot axis on the lower leg structure.

17. The exoskeleton according to claim 16, wherein the intermediate part is mounted on the lower leg structure and on the foot structure with passive pivot links.

18. The exoskeleton according to claim 16, further comprising a compression spring assembly, fixed, on the one hand, to the intermediate part and on the other hand, on the lower leg structure.

19. The exoskeleton according to claim 18, wherein the spring assembly comprises a first elastically deformable member, the first member being connected, on the one hand, to the intermediate part, between the first and the second pivot link, by means of a fastening element, and on the other hand, to the lower leg structure, said first member being configured to apply a tensile force on the intermediate part.

20. The exoskeleton according to claim 19, wherein the fastening element is flexible.

21. The exoskeleton according to claim 19, wherein the spring assembly further comprises a substantially elongated hollow body having a first end and a second end opposite the first end, said hollow body being mounted in a housing formed in the lower leg structure, the first end of the hollow body being facing a bottom of the housing and the first member being mounted in the housing and compressed between the bottom of said housing and the second end of the hollow body.

22. The exoskeleton according to claim 21, further comprising a second elastically deformable member, housed in the hollow body, the second member being fixed near the first end of the hollow body, the fastening element cooperating with the second member so that the second member is configured to tension the fastening element and the fastening element being housed in the hollow body and projecting from the first end of said hollow body and the bottom of the housing.

23. The exoskeleton according to claim 22, wherein the first member and/or the second member comprises a compression spring.

24. The exoskeleton according to claim 23, wherein the first member and the second member comprise a compression spring, the second member having a lower stiffness than the stiffness of the first member.

25. The exoskeleton according to one of claim 21, wherein the fastening element has a thickened portion, housed in the hollow body and the second member comprises a locking part configured to form a stop for the thickened portion.

26. The exoskeleton according to claim 21, wherein the fastening element further comprises a stopper fixed to the fastening element, and the hollow body further comprises a protrusion fixed to an inner wall of the hollow body and configured to cooperate with the stopper and form an obstacle for the stopper of the fastening element.

27. The exoskeleton according to claim 21, wherein the hollow body further comprises a bolt, fixed near its second end, the first member abutting against said bolt.

* * * * *